US007963236B2

(12) United States Patent
Kim

(10) Patent No.: US 7,963,236 B2
(45) Date of Patent: Jun. 21, 2011

(54) BOILER AND METHOD FOR CONTROLLING AIR AND FUEL RATIO USING AIR PRESSURE SENSOR

(75) Inventor: Si Hwan Kim, Inchon (KR)

(73) Assignee: Kyungdong Network Co., Ltd., Seoul (KR)

( * ) Notice: Subject to any disclaimer, the term of this patent is extended or adjusted under 35 U.S.C. 154(b) by 710 days.

(21) Appl. No.: 11/919,202

(22) PCT Filed: Sep. 14, 2005

(86) PCT No.: PCT/KR2005/003046

§ 371 (c)(1),
(2), (4) Date: Oct. 24, 2007

(87) PCT Pub. No.: WO2006/118368

PCT Pub. Date: Nov. 9, 2006

(65) Prior Publication Data

US 2009/0308293 A1 Dec. 17, 2009

(30) Foreign Application Priority Data

Apr. 29, 2005 (KR) ..... 10-2005-0035851

(51) Int. Cl.
*F23N 5/00* (2006.01)
*F23L 9/00* (2006.01)
*H02P 1/04* (2006.01)

(52) U.S. Cl. ..... 110/348; 110/297; 110/185; 318/471

(58) Field of Classification Search ..... 110/189, 110/185, 186, 191; 700/275, 299, 300; 73/1.06, 73/1.36, 1.71, 754, 714, 734; 137/7, 10, 137/12, 87.04
See application file for complete search history.

(56) References Cited

U.S. PATENT DOCUMENTS 4,677,357 A * 6/1987 Spence et al. ..... 110/189
5,010,827 A * 4/1991 Kychakoff et al. ..... 110/185

FOREIGN PATENT DOCUMENTS

| | | |
|---|---|---|
| JP | 9-96438 | 4/1997 |
| JP | 11-83192 | 3/1999 |
| KR | 1998-0003314 | 3/1998 |
| KR | 1998-075031 | 11/1998 |
| WO | WO-2006/118368 A1 | 11/2006 |

* cited by examiner

OTHER PUBLICATIONS

International Search Report for Application No. PCT/KR2005/003046, dated Jan. 17, 2006.

*Primary Examiner* — Kenneth B Rinehart
*Assistant Examiner* — David J Laux
(74) *Attorney, Agent, or Firm* — Nelson Mullins Riley & Scarborough LLP; Anthony A. Laurentano

(57) ABSTRACT

Disclosed is an air-fuel ratio control boiler using a air pressure sensor and method for controlling the air-fuel ratio thereof. The boiler is comprised of a fan, the air pressure sensor, a air pressure sensor voltage measurement unit, a air pressure sensor voltage compensation unit, and a controller, and previously compensates for noise factors caused by deviation (error) of a component property, a constituent, of the air pressure sensor so as to be matched to initial reference voltage prior to operating the fan, thereby maximizing the effectiveness of the air-fuel ratio. Further, the boiler makes it possible not only to exert an optimal fuel efficiency effect due to the maximization of combustion efficiency, but also to minimize discharge of harmful gases, thereby preventing environmental pollution in advance, and thus improving the reliability of products.

2 Claims, 3 Drawing Sheets

[Fig. 1]
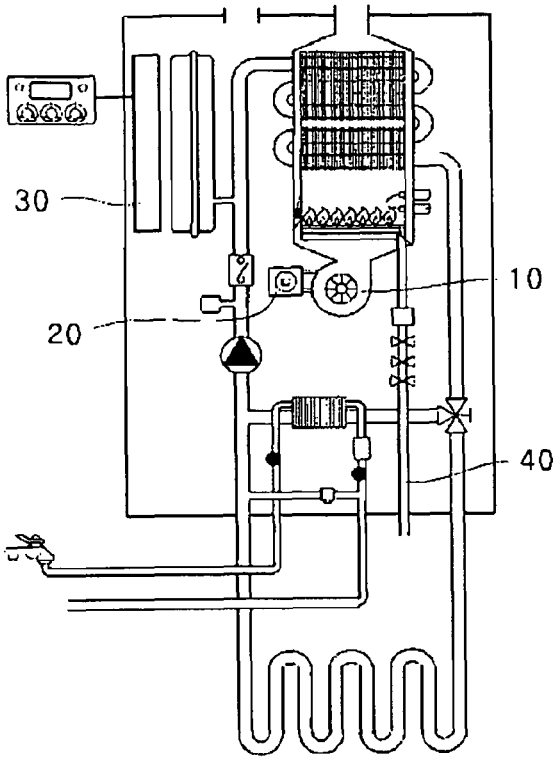
[Fig. 2]
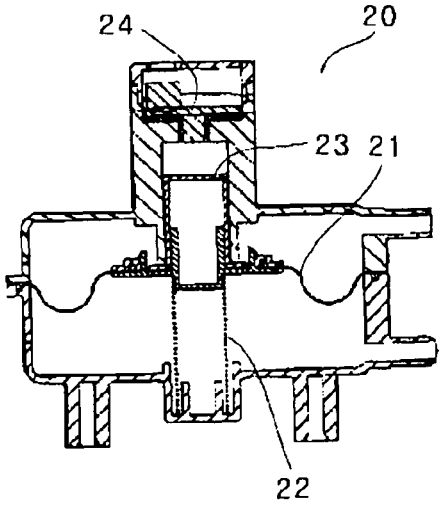
[Fig. 3]
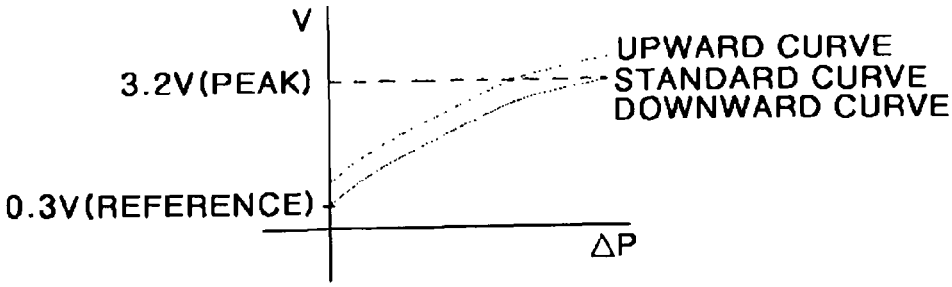

[Fig. 4]
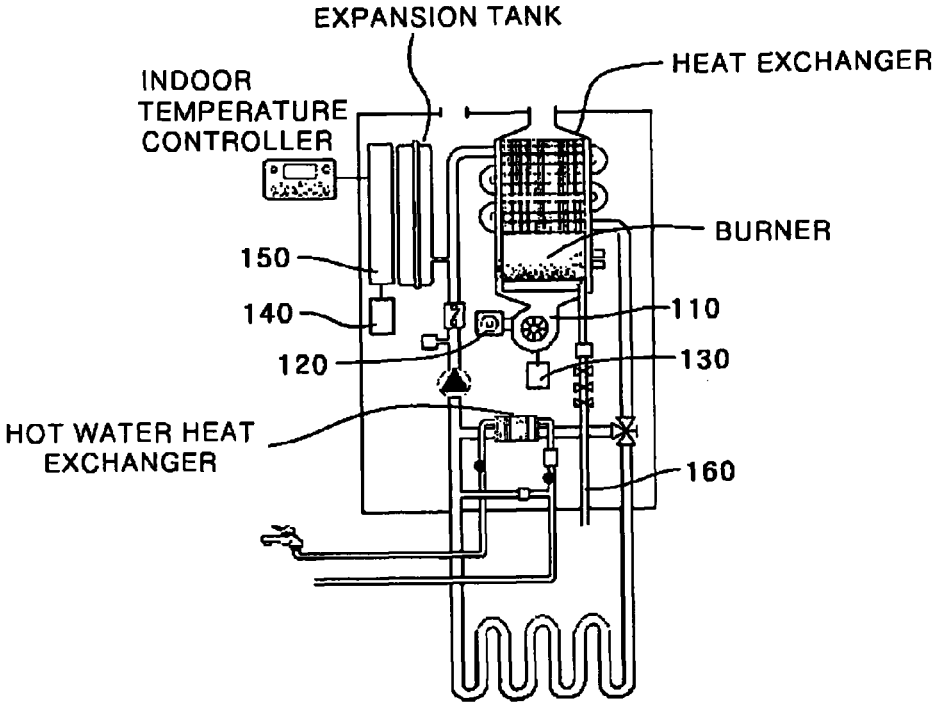
[Fig. 5]
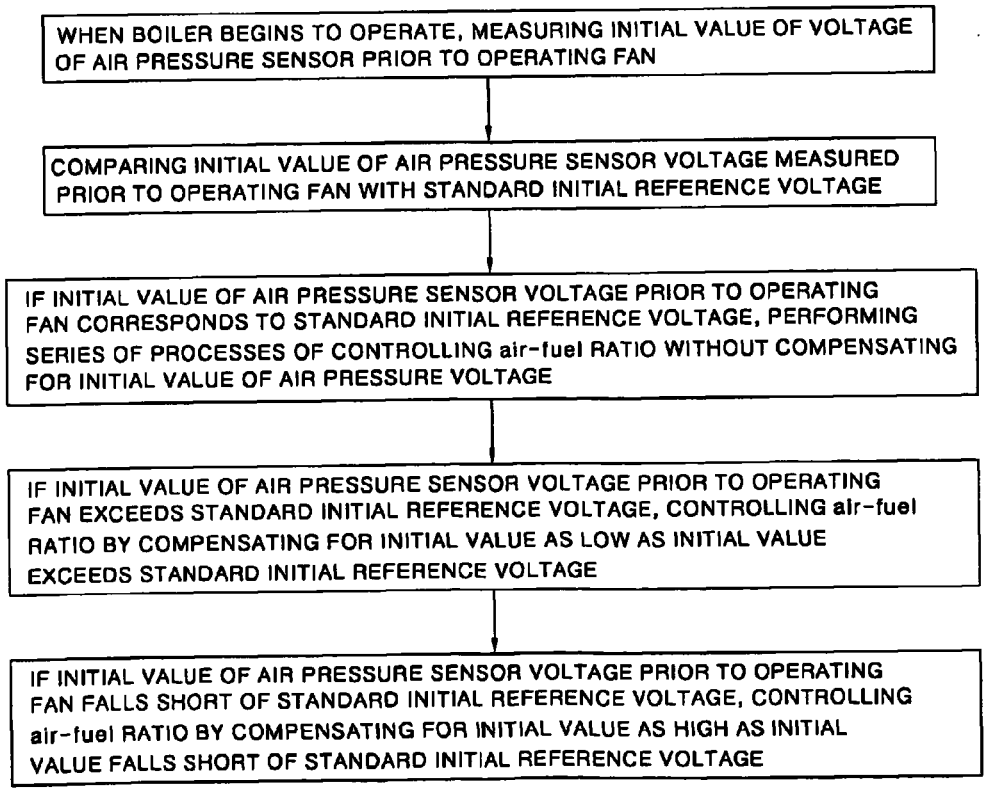

[Fig. 6]
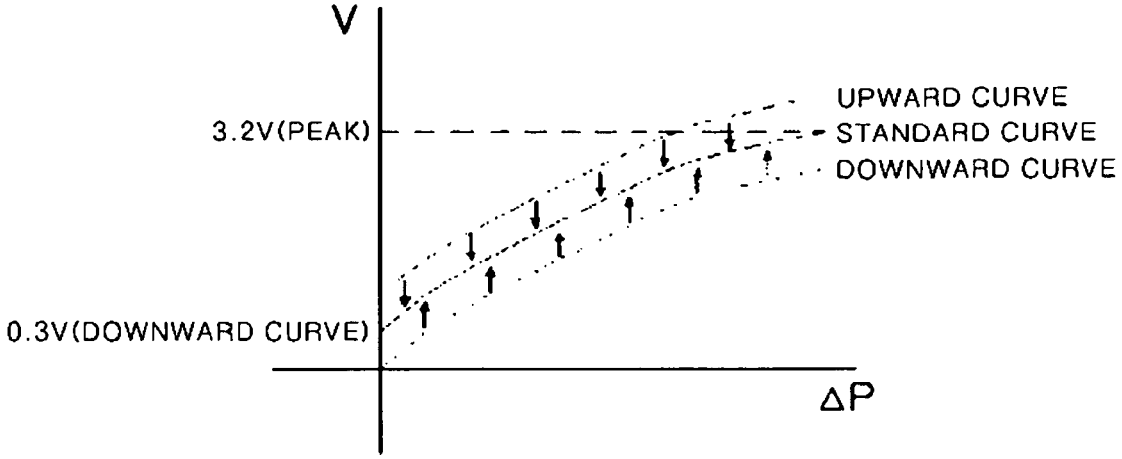

BOILER AND METHOD FOR CONTROLLING AIR AND FUEL RATIO USING AIR PRESSURE SENSOR

TECHNICAL FIELD

The present invention relates to an air-fuel ratio control boiler using a air pressure sensor and method for controlling the air-fuel ratio thereof, and more particularly to an air-fuel ratio control boiler using a air pressure sensor and method for controlling the air-fuel ratio thereof, capable of realizing optimal combustion efficiency and precise air-fuel ratio control to improve fuel efficiency of the boiler, and greatly increasing effectiveness to raise the reliability of products.

BACKGROUND ART

In general, boilers are machines for mixing and burning air and fuel. In these burners, combustion efficiency is determined depending on how accurately the mixing ratio of the air and the fuel is controlled.

In the boilers, an air proportional control system, or a current proportional control system is applied in order to control the air-fuel ratio. An accurate quantity of fuel is supplied in proportion to the pressure of air introduced by controlling the revolutions per minute (rpm) of a fan through the mode, and thereby the boilers can be increased in combustion efficiency and inhibit harmful gases from being discharged to the maximum extent. Here, the air proportional control system is adapted to appropriately maintain the air-fuel ratio by calculating the volume of supplied air for combustion based on a required calorie in terms of the rpm of a fan, automatically opening/closing an air proportional valve by the pressure of air introduced in proportion to the calculated rpm of the fan, and supplying a proper quantity of fuel. The current pro-portional control system is adapted to appropriately maintain the air-fuel ratio by calculating the volume of supplied air for combustion based on a required calorie in terms of the rpm of a fan, and controlling the current value of a current proportional valve for supplying fuel in correspondence to the rpm of the fan.

Further, there has recently appeared a boiler having a air pressure sensor allowed to measure the pressure of introduced air using differential pressure. As shown in FIG. 1, the boiler is comprised of a fan 10 sucking in air for combustion, a air pressure sensor 20 measuring the pressure of air sucked in by the fan 10, and a controller 30 receiving data on the air pressure measured by the air pressure sensor 20, controlling a quantity of fuel supplied through a fuel supply pipe 40 according to the input air pressure, adjusting the rpm of the fan 10 when the pressure of air sucked in is varied depending on the quantity of supplied fuel, and controlling the fan so as to allow a proper volume of air to be maintained based on the quantity of supplied fuel through the voltage measured by the air pressure sensor.

Although not shown, a venturi tube is installed on an air passage in the fan 10 so as to generate differential pressure through variation in cross section. The air pressure sensor 20 is connected to the venturi tube, thereby measuring the air pressure using the differential pressure generated at the venturi tube.

In this manner, the air pressure sensor 20, which measures the air pressure using the differential pressure, is composed of a diaphragm 21 moving up and down depending on variation of the air pressure, an elastic member 22, such as a spring, applying resilient force to the diaphragm 21, a reflecting member 23 going upward/downward according to up-down movement of the diaphragm 21, and a sensing member 24 sensing a difference in the movement of the reflecting member 23 to measure pressure.

Here, the sensing member 24 includes a light emitting element and a light receiving element. When the light emitting element emits light, the light is reflected on the reflecting member 23, and then the reflected light is received by the light receiving element. The sensing is based on principle that, as current is varied in proportion to a quantity of light received by the light receiving element, a value of measured voltage is varied.

The air pressure sensor 20 taking this construction and operation is disclosed in Korean Utility Model Registration No. 0353005, filed by the present applicant, the entire contents of which are incorporated herein by reference.

According to the conventional boiler having the above-mentioned air pressure sensor, it is possible not only to increase the combustion efficiency by the aid of the proper air-fuel ratio, but also have precise control so as to have the air-fuel ratio according to rated output required for the boiler. However, the conventional boiler has disadvantages in that an initial reference voltage value is varied with the arrival of hot/cold weather, that sensor properties are varied when used for a long time, and that an initial reference value is varied by dust or foreign materials on the reflecting member, variation of the resilient force of the elastic member, and so on.

In other words, the conventional boiler fails to eliminate various noise factors, such as property deviation of the air pressure sensor, deviation caused by resilient property of the spring or the elastic member, deviation caused by colors of the reflecting member, deviation caused by the rubber property of the diaphragm, and so on, so that it cannot control the optimal combustion efficiency or optimally maximized air-fuel ratio.

The description will be made in more detail with reference to FIG. 3. FIG. 3 is a graph plotting the relationship between voltage and pressure when a boiler operates. When the fan is driven, ordinary voltage of the fan should plot a standard curve graph having reference start voltage of 0.3 V and reference peak voltage of 3.2 V. However, due to the above-mentioned noise factors, the ordinary voltage of the fan plots an up-curve or down-curve graph on which both the start voltage and the peak voltage are equally raised or lowered on the whole, compared to the standard curve graph. Thereby, it is impossible to control the optimal combustion efficiency and the precise air-fuel ratio. Furthermore, the reliability of the products is lowered.

DISCLOSURE OF INVENTION

Technical Problem

Therefore, the present invention has been made in view of the above-mentioned problems, and it is an objective of the present invention to provide an air-fuel ratio control boiler using a air pressure sensor and method for controlling the air-fuel ratio thereof, adapted to overcome the variation of initial reference voltage caused by the arrival of hot/cold weather, component property deviation, and so on, namely efficiently cope with generation of noise factors of the air pressure sensor, thereby realizing optimal combustion efficiency and precise air-fuel ratio control to improve fuel efficiency of the boiler, greatly increasing effectiveness to raise the reliability of products.

Technical Solution

According to an aspect of the present invention, there is provided an air-fuel ratio control boiler having a fan sucking in air for combustion and provided with a venturi tube on an air passage so as to generate differential pressure, and a air pressure sensor connected with the venturi tube of the fan and measuring the pressure of the air using the differential pressure generated at the venturi tube. The air-fuel ratio control boiler comprises: a air pressure sensor voltage measurement unit for measuring an initial value of voltage of the air pressure sensor prior to operating the fan; a air pressure sensor voltage compensation unit for when a value of the data measured by the air pressure sensor voltage measurement unit exceeds or falls short of a reference value of the air pressure sensor voltage, compensating the exceeding or lacking reference value with reference voltage in advance; and a controller for receiving the data from the air pressure sensor voltage measurement unit, comparing the received data with initial reference voltage of the air pressure sensor, determining whether or not to compensate for the air pressure sensor voltage, operating the fan, receiving the measured air pressure data measured from the air pressure sensor to control a quantity of supplied fuel based on the air pressure, adjusting the revolutions per minute (rpm) of the fan when the pressure of air sucked in is varied depending on the quantity of supplied fuel, maintaining a proper volume of air based on the quantity of supplied fuel through the voltage measured by the air pressure sensor, and thereby controlling the fan.

According to another aspect of the present invention, there is provided a method for controlling an air-fuel ratio of a boiler using a air pressure sensor. The method comprises: a first step of, when the boiler begins to operate on the basis of a users setting, measuring an initial value of voltage of the air pressure sensor prior to operating a fan; a second step of determining whether or not the initial value of the air pressure sensor voltage measured in the first step corresponds to standard initial reference voltage; a third step of, if the initial value of the air pressure sensor voltage prior to operating the fan corresponds to the initial reference voltage in the second step, performing a series of processes of controlling the air-fuel ratio without compensating for the initial value of the air pressure voltage; a fourth step of, if the initial value of the air pressure sensor voltage prior to operating the fan exceeds the standard initial reference voltage in the second step, performing a series of processes of controlling the air-fuel ratio using the air pressure sensor in a state where the air pressure sensor voltage is caused to maintain the initial reference voltage by compensating for the initial value as low as the initial value exceeds the reference voltage; and a fifth step of, if the initial value of the air pressure sensor voltage prior to operating the fan falls short of the standard initial reference voltage in the second step, performing a series of processes of controlling the air-fuel ratio using the air pressure sensor in a state where the air pressure sensor voltage is caused to maintain the initial reference voltage by compensating for the initial value as high as the initial value falls short of the reference voltage.

Advantageous Effects

As described above, according to the air-fuel ratio control boiler using a air pressure sensor and the method for controlling the air-fuel ratio thereof, it is possible not only to improve the precise control over the boiler, but also maximize the combustion efficiency. Thereby, it is possible to minimize discharge of harmful gases and exert optimal fuel efficiency improvement effects.

This increase in the effectiveness of the air-fuel ratio makes it possible to raise the reliability of products.

BRIEF DESCRIPTION OF THE DRAWINGS

The foregoing and other objects, features and advantages of the present invention will become more apparent from the following detailed description when taken in conjunction with the accompanying drawings in which:

FIG. 1 illustrates a construction of a conventional boiler having a air pressure sensor;

FIG. 2 is a cross-sectional view illustrating an example of a conventional air pressure sensor;

FIG. 3 is a graph for explaining the relationship between voltage and pressure when a boiler operates;

FIG. 4 illustrates a construction of an air-fuel ratio control boiler using a air pressure sensor in accordance with the present invention;

FIG. 5 is a block flowchart illustrating a method for controlling an air-fuel ratio of a boiler using a air pressure sensor in accordance with the present invention; and FIG. 6 is a voltage-to-pressure graph for explaining air-fuel ratio control according to the present invention.

MODE FOR THE INVENTION

Reference will now be made in detail to the exemplary embodiments of the present invention.

FIG. 4 illustrates a schematic construction of an air-fuel ratio control boiler using a air pressure sensor in accordance with the present invention. FIG. 5 is a block flowchart illustrating a method for controlling an air-fuel ratio of a boiler using a air pressure sensor in accordance with the present invention. FIG. 6 is a voltage-to-pressure graph for explaining air-fuel ratio control according to the present invention.

As illustrated in FIG. 4, the air-fuel ratio control boiler using a air pressure sensor in accordance with the present invention is comprised of a fan 110 that sucks in air for combustion and is provided with a venturi tube on an air passage so as to generate differential pressure, the air pressure sensor 120 that is connected with the venturi tube of the fan 110 and measures pressure of the air using the differential pressure generated at the venturi tube, a air pressure sensor voltage measurement unit 130 that measures an initial value of voltage of the air pressure sensor prior to operating the fan 110, a air pressure sensor voltage compensation unit 140 that, when a value of the data measured by the air pressure sensor voltage measurement unit 130 exceeds or falls short of a reference value of the air pressure sensor voltage, compensates it with reference voltage in advance, and a controller 150 that receives the data from the air pressure sensor voltage measurement unit 130, compares the received data with the initial reference voltage of the air pressure sensor, determines whether or not to compensate for the air pressure sensor voltage, operates the fan 110, receives the measured air pressure data measured from the air pressure sensor 120 to control a quantity of supplied fuel based on the air pressure, adjusts the revolutions per minute (rpm) of the fan 110 when the pressure of air sucked in is varied depending on the quantity of supplied fuel, maintains a proper volume of air based on the quantity of supplied fuel through the voltage measured by the air pressure sensor, and thereby controls the fan.

A reference number 160, not described, denotes a fuel supply pipe for supplying fuel.

An operation of the air-fuel ratio control boiler using a air pressure sensor, having this construction, in accordance with the present invention will be described with reference to FIGS. 4 to 6.

First, when the boiler begins to operate on the basis of a users setting after power is applied, an initial value of voltage of the air pressure sensor is measured through the air pressure sensor voltage measurement unit 130 prior to operating the fan 110, and the measured data is transmitted to the controller 150.

The controller 150 determines whether or not the input initial value of the air pressure sensor voltage corresponds to ordinary initial reference voltage. If so, a standard curve is plotted, as shown in FIG. 6. Hence, the controller 150 performs a series of processes of controlling the fan, such as operating the fan 110, without compensating for the initial value of the air pressure sensor voltage, receiving measurement data from the air pressure sensor 120 that measures the pressure of air using differential pressure, controlling a quantity of supplied fuel based on the air pressure, adjusting the rpm of the fan 110 when the pressure of air sucked in is varied depending on the quantity of supplied fuel, and maintaining a proper volume of air based on the quantity of supplied fuel through the voltage measured by the air pressure sensor.

Further, if the initial value of the air pressure sensor voltage prior to operating the fan exceeds the ordinary initial reference voltage, an upward curve located above the standard curve is plotted, as shown in FIG. 6. Hence, the controller 150 compensates for the initial value as low as the initial value of the air pressure sensor voltage exceeds the ordinary initial reference voltage by means of the air pressure sensor voltage compensation unit 140, thereby causing the air pressure sensor voltage to maintain the initial reference voltage. In this state, the controller 150 operates the fan 110, so that it performs air proportional control using the air pressure sensor 120. If the initial value of the air pressure sensor voltage prior to operating the fan falls short of the ordinary initial reference voltage, a downward curve located below the standard curve is plotted, as shown in FIG. 6. Hence, the controller 150 compensates for the initial value as high as the initial value of the air pressure sensor voltage falls short of the ordinary initial reference voltage by means of the air pressure sensor voltage compensation unit 140, thereby causing the air pressure sensor voltage to maintain the initial reference voltage. In this state, the controller 150 operates the fan 110, so that it performs air proportional control using the air pressure sensor 120.

In this manner, the air-fuel ratio control boiler using a air pressure sensor in accordance with the present invention previously compensates for noise factors caused by deviation (error) of the component property, the constituent, of the air pressure sensor 120 so as to be matched to the initial reference voltage prior to operating the fan, and compensates for deviation of the property variation of the initial reference voltage of the air pressure sensor when used for a long time, thereby maximizing the effectiveness of the air-fuel ratio. In other words, the air-fuel ratio control boiler makes it possible not only to exert an optimal air-fuel ratio effect due to the maximization of combustion efficiency, but also to minimize discharge of harmful gases, thereby preventing environmental pollution in advance.

INDUSTRIAL APPLICABILITY

As can be seen from the foregoing, the present invention is applied to boilers, so that it can accurately control the optimal combustion efficiency and the air-fuel ratio.

While this invention has been described in connection with what is presently considered to be the most practical and exemplary embodiment, it is to be understood that the invention is not limited to the disclosed embodiment and the drawings, but, on the contrary, it is intended to cover various modifications and variations within the spirit and scope of the appended claims.

The invention claimed is:

1. A method for controlling an air-fuel ratio of a boiler using an air pressure sensor, the method comprising:

a first step of, when the boiler begins to operate on the basis of a user's setting, measuring an initial value of voltage of the air pressure sensor prior to operating a fan;

a second step of determining whether or not the initial value of the air pressure sensor voltage measured in the first step corresponds to a standard initial reference voltage;

a third step of, if the initial value of the air pressure sensor voltage prior to operating the fan corresponds to the standard initial reference voltage in the second step, performing a series of processes of controlling the air-fuel ratio without compensating for the initial value of the air pressure voltage;

a fourth step of, if the initial value of the air pressure sensor voltage prior to operating the fan exceeds the standard initial reference voltage in the second step, compensating the initial value by an amount that corresponds to the amount that the initial value exceeds the standard initial reference voltage so as to maintain the initial value at the standard initial reference voltage and then performing a series of processes of controlling the air-fuel ratio using the air pressure sensor; and a fifth step of, if the initial value of the air pressure sensor voltage prior to operating the fan falls short of the standard initial reference voltage in the second step, compensating the initial value by an amount that corresponds to the amount that the initial value falls short of the standard initial reference voltage so as to maintain the initial value at the standard initial reference voltage and then performing a series of processes of controlling the air-fuel ratio using the air pressure sensor.

2. An air-fuel ratio control boiler having a fan sucking in air for combustion and provided with a venturi tube on an air passage so as to generate differential pressure, and an air pressure sensor connected with the venturi tube of the fan and measuring pressure of the air using the differential pressure generated at the venturi tube, the air-fuel ratio control boiler comprising:

an air pressure sensor voltage measurement unit for measuring an initial value of voltage of the air pressure sensor prior to operating the fan;

an air pressure sensor voltage compensation unit for, when the initial value of voltage of the air pressure sensor measured by the air pressure sensor voltage measurement unit prior to operating the fan exceeds a reference value of the air pressure sensor voltage, compensating the exceeding initial value in advance in order for the air pressure sensor voltage to maintain the initial reference voltage, and when the initial value of voltage of the air pressure sensor measured by the air pressure sensor voltage measurement unit prior to operating the fan falls short of the reference voltage of the air pressure sensor voltage, compensating the lacking initial value in advance in order for the air pressure sensor voltage to maintain the initial reference voltage; and a controller for receiving data representative of the initial value of voltage of the air pressure sensor from the air pressure sensor voltage measurement unit, comparing the received data of the initial value of voltage of the air pressure sensor with the initial reference voltage of the air pressure sensor, determining whether or not to compensate for the air pressure sensor voltage, operating the fan, receiving the measured air pressure data measured from the air pressure sensor to control a quantity of supplied fuel based on the air pressure, adjusting the revolutions per minute (rpm) of the fan when the pressure of air sucked in is varied depending on the quantity of supplied fuel, maintaining a proper volume of air based on the quantity of supplied fuel through the voltage measured by the air pressure sensor, and thereby controlling the fan.

* * * * *